US011402141B1

(12) United States Patent
Polk

(10) Patent No.: US 11,402,141 B1
(45) Date of Patent: Aug. 2, 2022

(54) REFRIGERATOR AND FREEZER CONVERSION SYSTEM

(71) Applicant: Tracy Polk, Blackwood, NJ (US)

(72) Inventor: Tracy Polk, Blackwood, NJ (US)

( * ) Notice: Subject to any disclaimer, the term of this patent is extended or adjusted under 35 U.S.C. 154(b) by 0 days.

(21) Appl. No.: 17/108,071

(22) Filed: Dec. 1, 2020

(51) Int. Cl.
*F25D 11/02* (2006.01)
*F25B 5/02* (2006.01)

(52) U.S. Cl.
CPC ..... *F25D 11/022* (2013.01); *F25B 5/02* (2013.01); *F25B 2600/2513* (2013.01)

(58) Field of Classification Search
CPC ..... F25D 11/00; F25D 11/02; F25D 11/022; F25B 5/02; F25B 2600/2513
See application file for complete search history.

(56) References Cited

U.S. PATENT DOCUMENTS 3,411,312 A 11/1968 Sigi
3,638,450 A * 2/1972 Falk ..... B60P 3/205 62/329
3,745,786 A 7/1973 Laughlin
4,304,101 A 12/1981 Gidseg
5,839,287 A 11/1998 Stormo
5,899,083 A * 5/1999 Peterson ..... F25D 17/045 62/186
5,964,101 A * 10/1999 Schulak ..... F24D 11/0214 62/430
6,230,514 B1 * 5/2001 Schulak ..... F24D 11/0214 62/434
6,370,908 B1 * 4/2002 James ..... F25D 11/006 62/434
6,463,755 B2 * 10/2002 Schulak ..... F24D 11/0214 62/440
6,467,298 B2 * 10/2002 Schulak ..... F24D 11/0214 62/440
7,051,539 B2 5/2006 Junge
7,895,859 B2 * 3/2011 Anselmino ..... F25C 5/182 62/344
8,336,321 B2 * 12/2012 Cur ..... F25D 11/025 62/175
8,627,679 B2 * 1/2014 Anselmino ..... F25C 5/182 62/344
8,720,221 B2 * 5/2014 Anselmino ..... F25C 5/182 62/344
8,725,455 B2 * 5/2014 Kriss ..... F25D 29/008 702/179
9,080,801 B2 * 7/2015 Arjomand ..... F25D 1/00
9,683,771 B2 * 6/2017 Anselmino ..... F25C 5/182
(Continued)

*Primary Examiner* — Miguel A Diaz
(74) *Attorney, Agent, or Firm* — Kyle A. Fletcher, Esq.

(57) ABSTRACT

The refrigerator and freezer conversion system addresses the problem described above. The refrigerator and freezer conversion system is configured for use with a refrigerator. The refrigerator and freezer conversion system incorporates an insulating cabinet and a refrigeration system. The refrigeration system maintains the temperature within the insulating cabinet. The insulating cabinet is organized into a plurality of chambers. The refrigeration system independently maintains the temperature within each of the plurality of chambers. By independently maintained is meant that the temperature maintained in any initial chamber selected from the plurality of chambers is not affected by the temperature of any subsequent chamber selected from the plurality of chambers.

19 Claims, 6 Drawing Sheets

(56) References Cited

U.S. PATENT DOCUMENTS 9,988,946 B2 * 6/2018 Atalla ..... F01K 7/22
10,274,231 B2 * 4/2019 Schroeder ..... F25D 11/02
10,337,964 B2 * 7/2019 Kriss ..... F24F 1/0071
10,451,320 B2 * 10/2019 Benedict ..... F25B 21/00
10,451,322 B2 * 10/2019 Schroeder ..... F25D 23/006
D876,493 S 2/2020 Fidler
10,648,703 B2 * 5/2020 Schroeder ..... F04B 1/053
10,837,873 B2 * 11/2020 Kriss ..... G01R 21/00
10,928,126 B2 * 2/2021 Chung ..... F25D 31/005
11,015,843 B2 * 5/2021 Schroeder ..... F25D 11/02
2001/0015076 A1 * 8/2001 Schulak ..... F25D 16/00 62/440
2002/0108393 A1 * 8/2002 Schulak ..... F25D 23/061 62/440
2002/0144482 A1 * 10/2002 Henson ..... E04B 1/803 52/631
2005/0144971 A1 * 7/2005 Zabtcioglu ..... F25D 3/102 62/457.9
2006/0288729 A1 * 12/2006 Arjomand ..... F24F 1/027 62/441
2011/0224947 A1 * 9/2011 Kriss ..... G01R 21/00 702/179
2013/0098082 A1 * 4/2013 Cur ..... F25B 5/02 62/117
2014/0245758 A1 * 9/2014 Gu ..... F25D 11/00 62/56
2015/0143828 A1 * 5/2015 Atalla ..... F01K 25/10 62/115
2016/0018115 A1 * 1/2016 Arjomand ..... F25D 23/12 454/204
2018/0023852 A1 * 1/2018 Schroeder ..... F04B 9/042 62/3.1
2018/0340715 A1 * 11/2018 Benedict ..... F25D 11/02
2019/0024955 A1 * 1/2019 Schroeder ..... F25B 30/02
2019/0212055 A1 * 7/2019 Chung ..... F25B 5/02
2020/0003463 A1 * 1/2020 Kariya ..... F25B 30/02
2020/0224951 A1 * 7/2020 Seong ..... F25D 11/022
2020/0378655 A1 * 12/2020 Schroeder ..... F25D 11/02
2021/0033332 A1 * 2/2021 Vijayan ..... F25D 17/067
2021/0088247 A1 * 3/2021 Kriss ..... F25D 29/00
2021/0088390 A1 * 3/2021 Kriss ..... F25D 29/00
2021/0116160 A1 * 4/2021 Mrzyglod ..... F25B 5/04
2021/0164707 A1 * 6/2021 Weng ..... F25B 49/02
2021/0222946 A1 * 7/2021 Kulkarni ..... F25D 29/003

* cited by examiner

REFRIGERATOR AND FREEZER CONVERSION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of refrigeration, more specifically, a configuration for circulating a refrigerant. (F25D17/00)

A refrigerator is a domestic appliance that creates a temperature controlled protected space typically used for the storage of foodstuff. The refrigerator is organized in two chambers. The refrigerator maintains the first chamber a temperature suitable for storing frozen foodstuffs (typically 0 F). The refrigerator maintains the second chamber at a temperature suitable for storing fresh foods (typically 35-38 F). The first chamber and the second chambers are contained within the refrigerator. The first chamber and the second chambers have a fixed volume.

One problem with refrigerators is that the fixed volume of the first chamber and the second chamber does not allow for the adjustment of the volume of each environmental condition within the refrigerator in order to adapt to the types of foodstuff that needs to be stored in the refrigerator.

SUMMARY OF INVENTION

The refrigerator and freezer conversion system addresses the problem described above. The refrigerator and freezer conversion system is configured for use with a refrigerator. The refrigerator and freezer conversion system comprises an insulating cabinet and a refrigeration system. The refrigeration system maintains the temperature within the insulating cabinet. The insulating cabinet is organized into a plurality of chambers. The refrigeration system independently maintains the temperature within each of the plurality of chambers. By independently maintained is meant that the temperature maintained in any initial chamber selected from the plurality of chambers is not affected by the temperature of any subsequent chamber selected from the plurality of chambers.

These together with additional objects, features and advantages of the refrigerator and freezer conversion system will be readily apparent to those of ordinary skill in the art upon reading the following detailed description of the presently preferred, but nonetheless illustrative, embodiments when taken in conjunction with the accompanying drawings.

In this respect, before explaining the current embodiments of the refrigerator and freezer conversion system in detail, it is to be understood that the refrigerator and freezer conversion system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the refrigerator and freezer conversion system.

It is therefore important that the claims be regarded as including such equivalent construction insofar as they do not depart from the spirit and scope of the refrigerator and freezer conversion system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
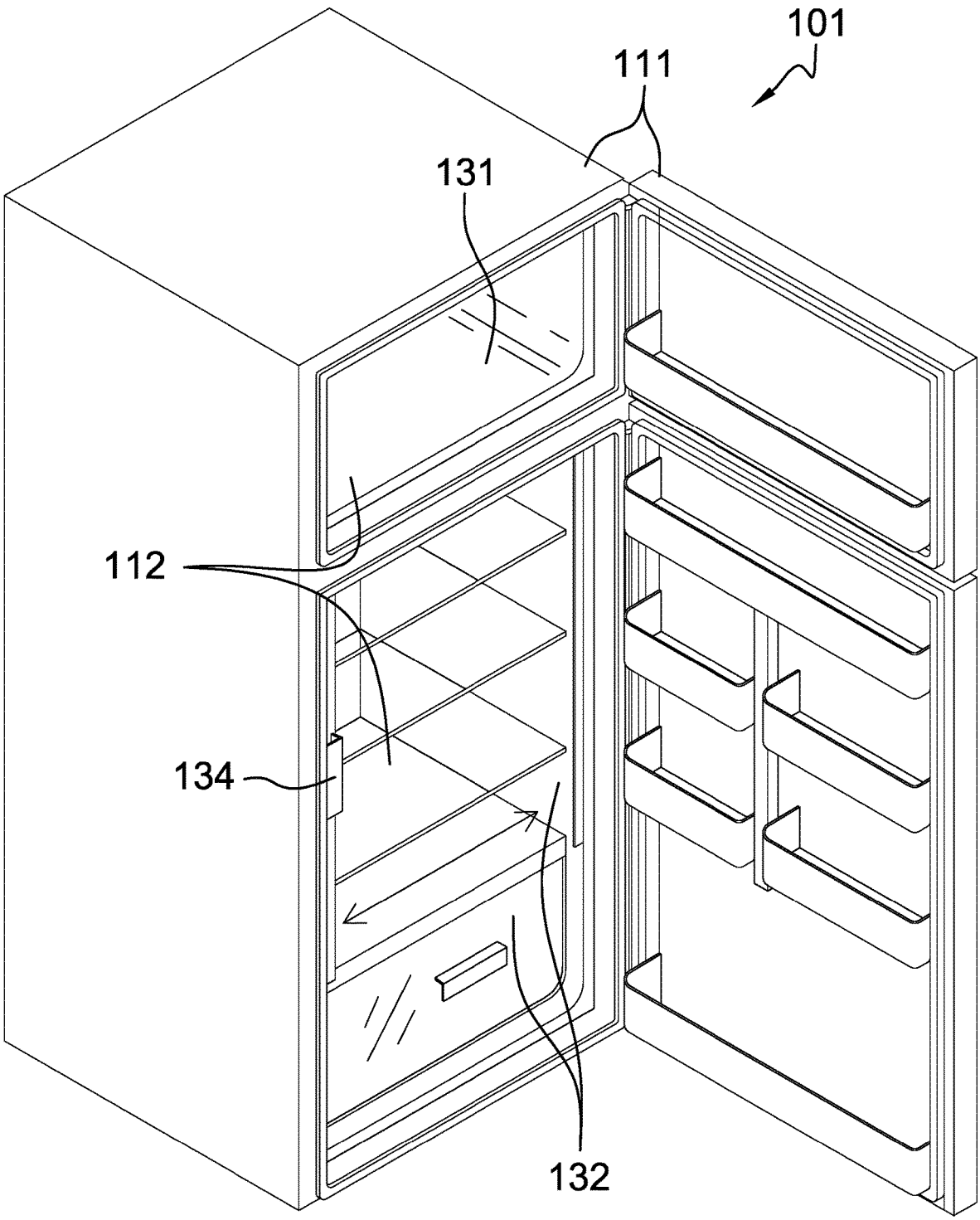
FIG. 1 is a perspective view of an embodiment of the disclosure.
Figure 2:
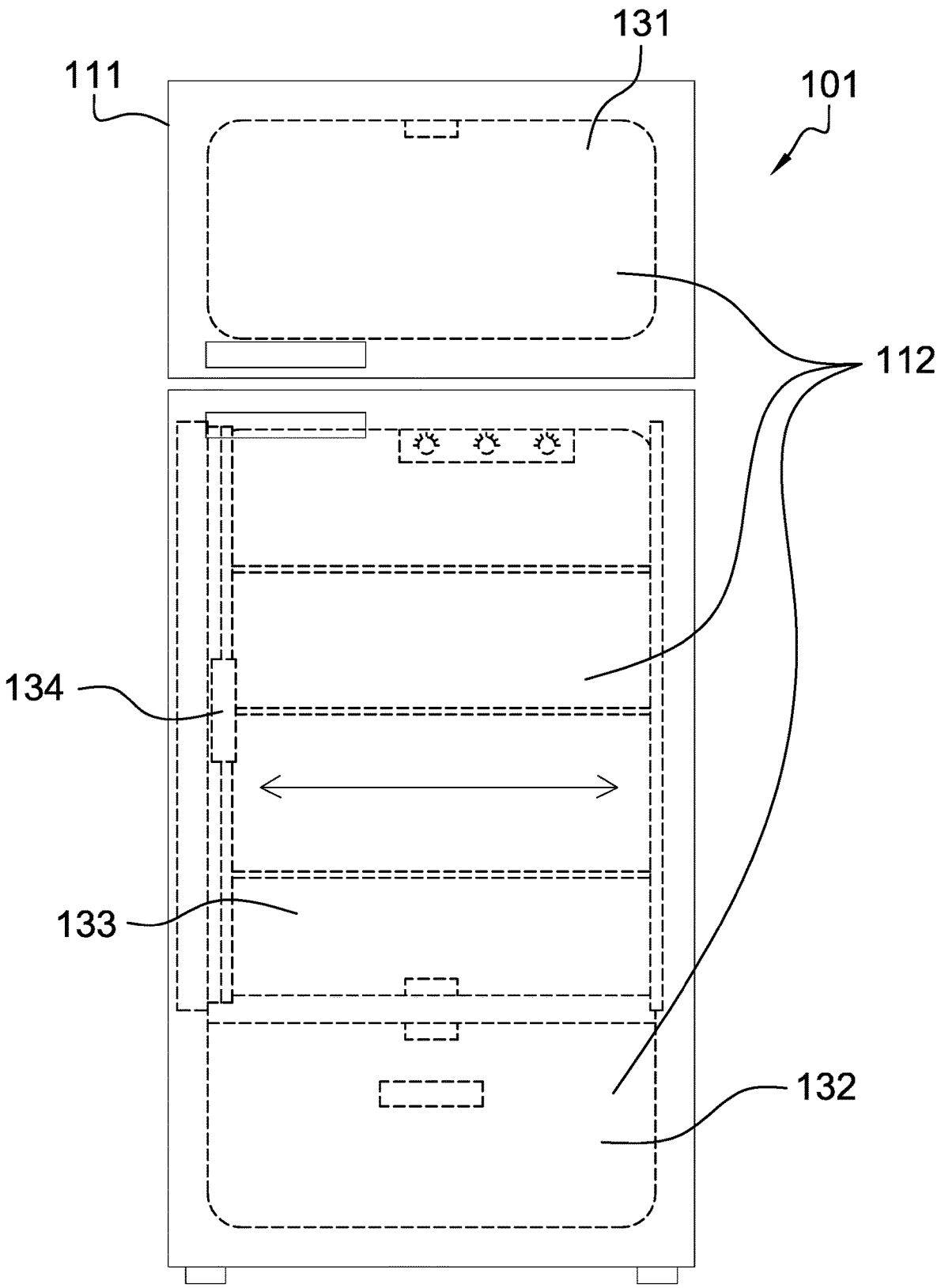
FIG. 2 is a front view of an embodiment of the disclosure.
Figure 3:
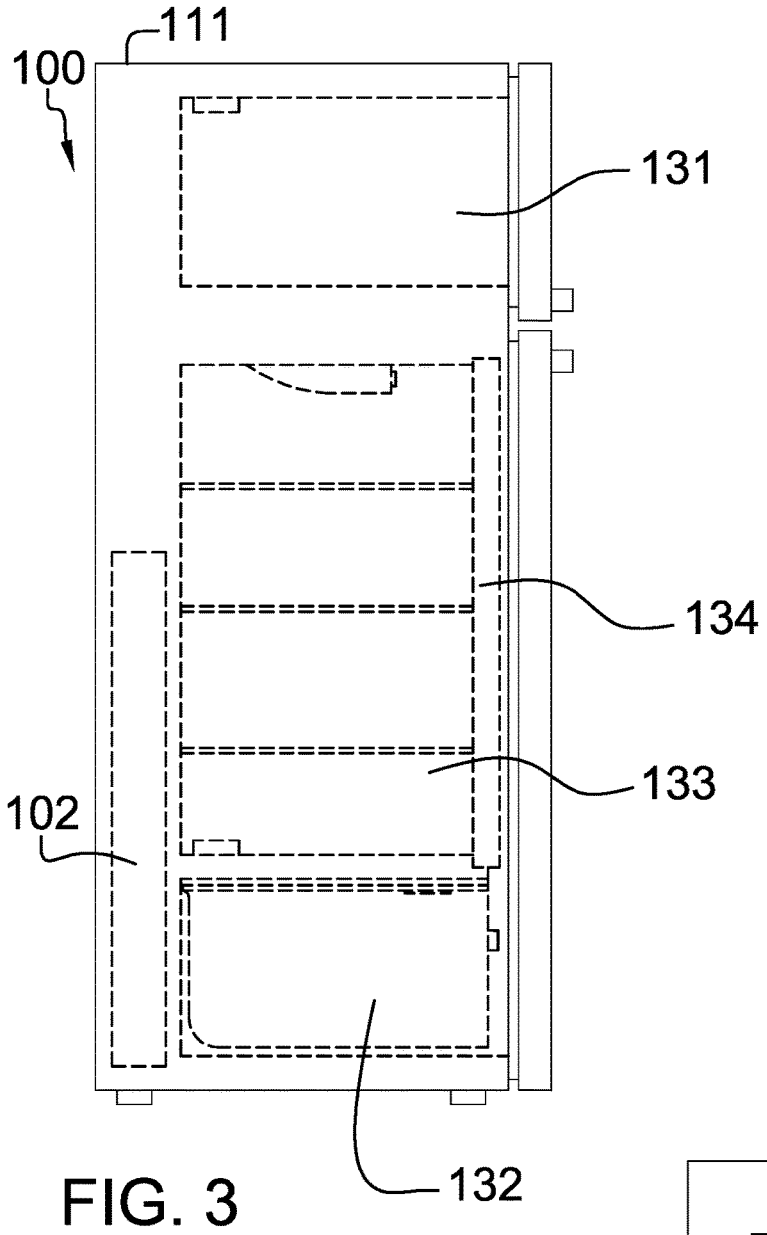
FIG. 3 is a side view of an embodiment of the disclosure.
Figure 4:
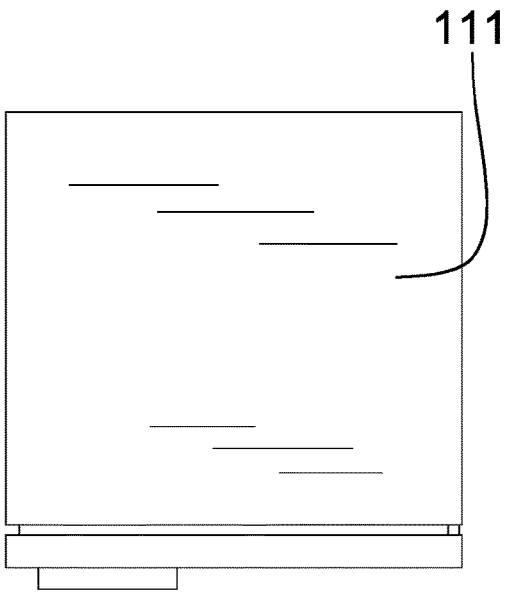
FIG. 4 is a top view of an embodiment of the disclosure.
Figure 5:
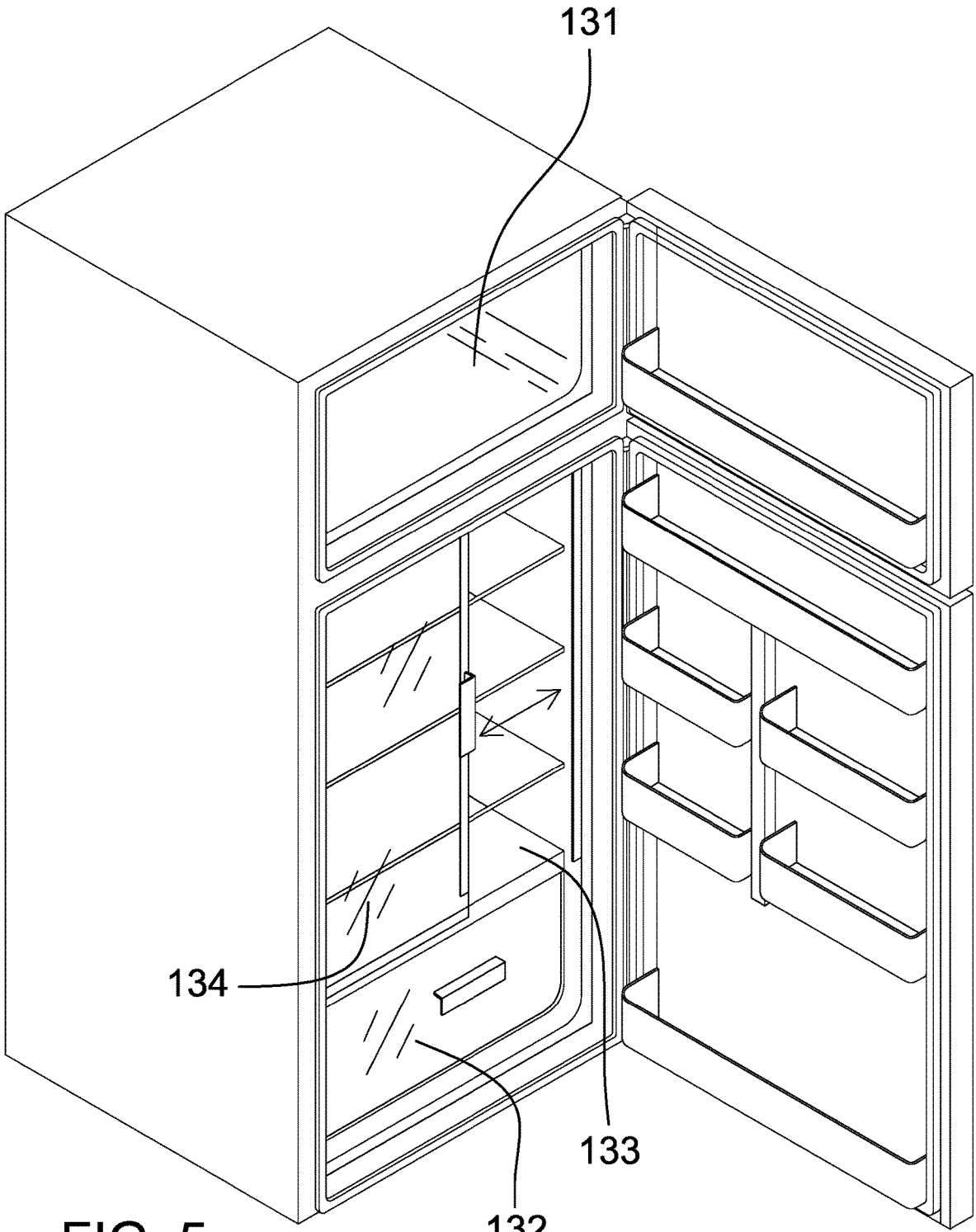
FIG. 5 is an in-use view of an embodiment of the disclosure.
Figure 6:
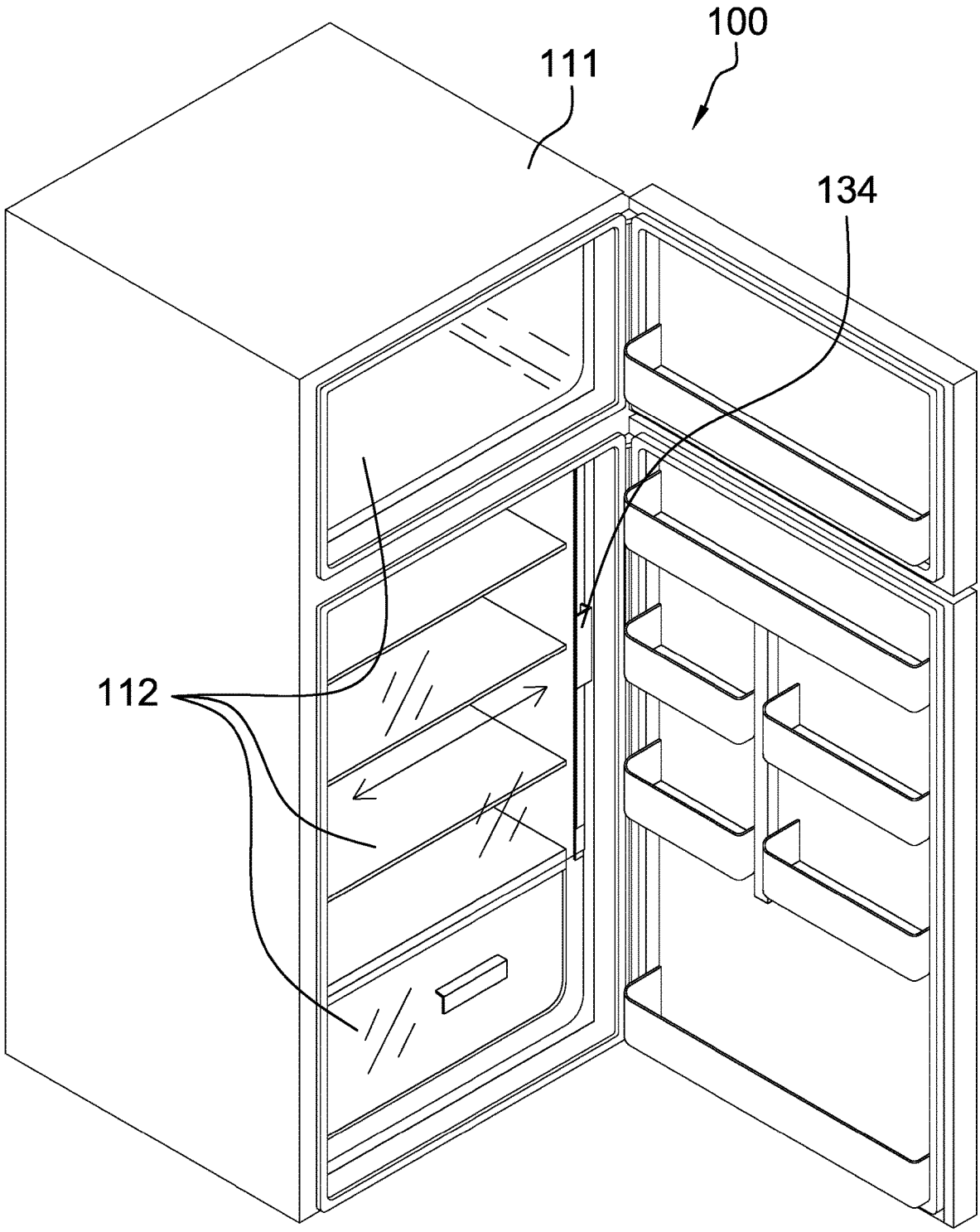
FIG. 6 is an in-use view of an embodiment of the disclosure.
Figure 7:
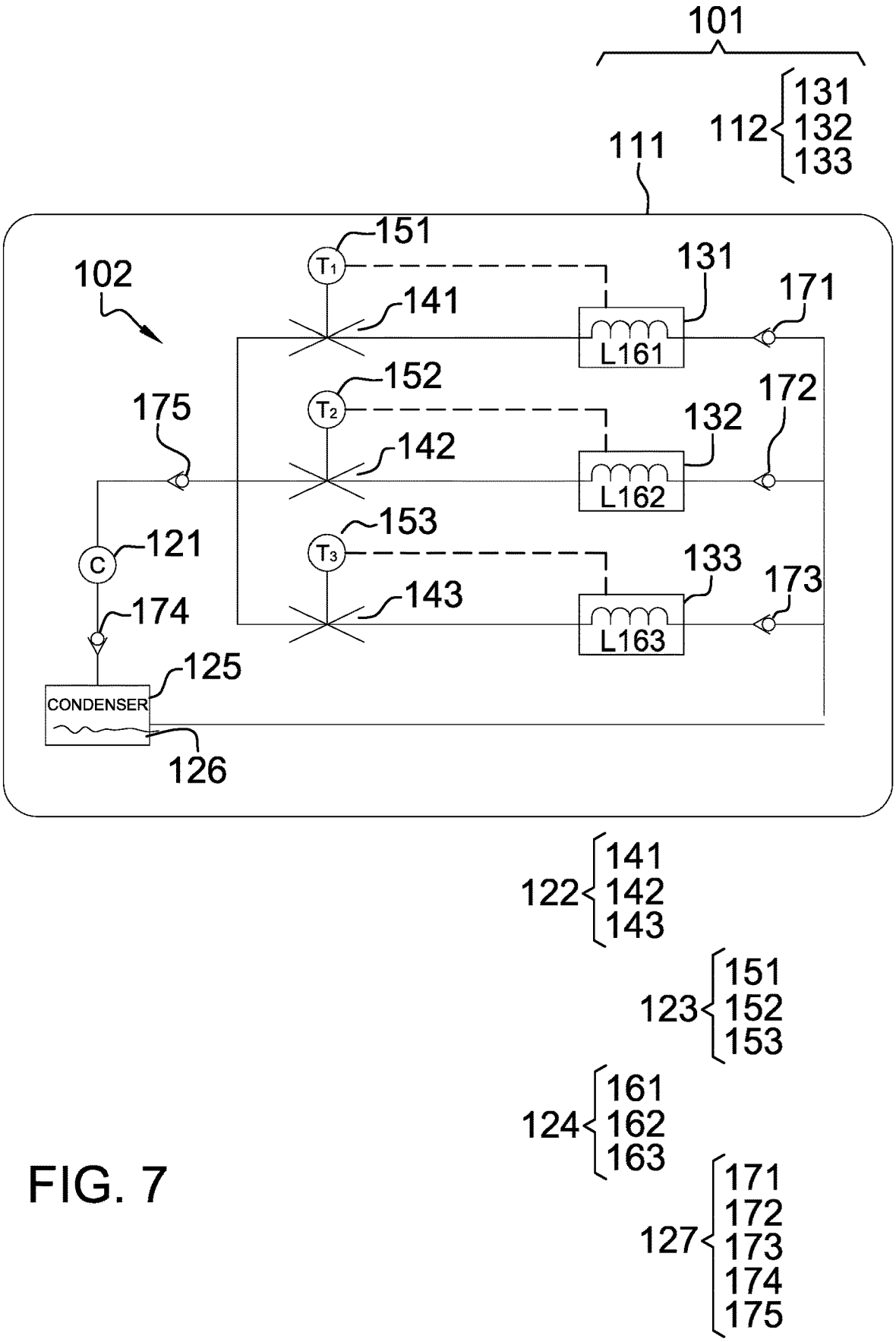
FIG. 7 is a schematic view of an embodiment of the disclosure.

Detailed reference will now be made to one or more potential embodiments of the disclosure, which are illustrated in FIGS. 1 through 7.

The refrigerator and freezer conversion system 100 (hereinafter invention) is configured for use with a refrigerator. The invention 100 comprises an insulating cabinet 101 and a refrigeration system 102. The refrigeration system 102 maintains the temperature within the insulating cabinet 101. The insulating cabinet 101 is organized into a plurality of chambers 112. The refrigeration system 102 independently maintains the temperature within each of the plurality of chambers 112. By independently maintained is meant that the temperature maintained in any initial chamber selected from the plurality of chambers 112 is not affected by the temperature of any subsequent chamber selected from the plurality of chambers 112.

The insulating cabinet 101 is an enclosable container. The insulating cabinet 101 forms the exterior surfaces of the invention 100. The insulating cabinet 101 is an insulating structure. The insulating cabinet 101 maintains an independent temperature within each chamber selected from the plurality of chambers 112 that are contained in the insulating cabinet 101. The temperature maintained in each selected cabinet within the insulating cabinet 101 is adjustable. The insulating cabinet 101 comprises an outer insulating shell 111 and a plurality of chambers 112.

The outer insulating shell 111 forms the exterior structure of the invention 100. The outer insulating shell 111 is an insulating structure. The outer insulating shell 111 is a hollow structure. The outer insulating shell 111 forms the primary containment structure that stores the foodstuff. The outer insulating shell 111 contains the plurality of chambers 112. The outer insulating shell 111 contains the refrigeration system 102. The outer insulating shell 111 forms an enclosable space that provides access to each of the plurality of chambers 112. The outer insulating shell 111 is subdivided into the plurality of chambers 112.

Each of the plurality of chambers 112 stores a portion of the foodstuff contained within the outer insulating shell 111. Each of the plurality of chambers 112 forms a temperature controlled space. Each of the plurality of chambers 112 is an independent structure. By independent structure is meant that the temperature maintained in any chamber initially selected from the plurality of chambers 112 is not affected by the temperature of any subsequent chamber selected from the plurality of chambers 112. The refrigeration system 102 provides the energy transfer technologies necessary to maintain the temperature in each chamber selected from the plurality of chambers 112. The plurality of chambers 112 further comprises a first chamber 131, a second chamber 132, a third chamber 133, and a chamber divider 134.

The first chamber 131 is a permanent chamber that is formed in the hollow interior of the outer insulating shell 111. The temperature within the first chamber 131 is adjustable. The first chamber 131 is intended to store foodstuff in a frozen condition. The second chamber 132 is a permanent chamber that is formed in the hollow interior of the outer insulating shell 111. The temperature within the second chamber 132 is adjustable. The second chamber 132 is intended to store foodstuff in a thawed condition.

The third chamber 133 is a temporary structure formed within the second chamber 132. The third chamber 133 removably installs in the second chamber 132. The temperature within the third chamber 133 is adjustable. The third chamber 133 is intended to store foodstuff in condition selected from the group consisting of a thawed condition and a frozen condition. The temperature within the third chamber 133 is adjustable. The third chamber 133 is intended to store foodstuff in a condition selected from the group consisting of a thawed condition and a frozen condition.

The chamber divider 134 is an insulating structure. The chamber divider 134 removably installs in the second chamber 132 to form the third chamber 133. The chamber divider 134 forms a gas impermeable structure that prevents the exchange of gas between the second chamber 132 and the third chamber 133 such that the refrigeration system 102 controls the temperature within the third chamber 133 independently from the temperature in the second chamber 132. The chamber divider 134 forms an enclosable space such that any foodstuff contained in the third chamber 133 is accessible through the second chamber 132.

The refrigeration system 102 is a mechanical implementation of a fluidic circuit called the Carnot cycle The refrigeration system 102 is used to cool the plurality of chambers 112 within the insulating cabinet 101. The refrigeration system 102 pressurizes a refrigerant 126 that is used by the refrigeration system 102 to implement the Carnot cycle. The refrigerant 126 is a compressible fluid that is pumped through a fluidic circuit used by the refrigeration system 102 to create the Carnot cycle. The refrigeration system 102 places the refrigerant 126 under pressure such that the refrigerant 126 generates a cooling effect when the pressure that the refrigerant 126 is under is subsequently released by the refrigeration system 102. The refrigeration system 102 comprises a compressor 121, a plurality of expansion valves 122, a plurality of thermostats 123, a plurality of heat exchange coils 124, a condenser 125, a refrigerant 126, and a plurality of check valves 127. The compressor 121, the plurality of expansion valves 122, the plurality of thermostats 123, the plurality of heat exchange coils 124, the condenser 125, and the plurality of check valves 127 transport the refrigerant 126 through a fluidic circuit.

The compressor 121 is a mechanical device. The compressor 121 forms a fluidic series connection from the condenser 125 to the plurality of expansion valves 122. The compressor 121 draws the refrigerant 126 from the condenser 125. The compressor 121 places the refrigerant 126 under pressure such that the refrigerant 126 is transported under pressure to the plurality of expansion valves 122.

Each plurality of expansion valves 122 is a mechanical device. The plurality of expansion valves 122 forms a fluidic series connection from the compression pump 121 to a heat exchange coil selected from the plurality of heat exchange coils 124. Each selected heat exchange coil forms a volume expansion structure that controls the pressure of the refrigerant 126 as the refrigerant 126 decreases the temperature of the heat exchange coil within a chamber selected from the plurality of chambers 112. The temperature drop generated by the selected heat exchange coil is used to cool the hollow interior of the chamber selected from the plurality of chambers 112 that is associated with the selected heat exchange coil.

Each expansion valve selected from the plurality of expansion valves 122 installs between the compression pump 121 and a heat exchange coil selected from the plurality of heat exchange coils 124. Each of the plurality of expansion valves 122 directly controls the pressure of the refrigerant 126 as the refrigerant 126 enters the heat exchange coil associated with the selected expansion valve.

The condenser 125 is a mechanical device. The condenser 125 is a containment structure. The condenser 125 forms a fluidic series connection from the condenser 125 to the compression pump 121. The condenser 125 forms a reservoir that contains the refrigerant 126 when the compressor 121 is not in operation.

Each of the plurality of thermostats 123 are control structures. Each thermostat selected from the plurality of thermostats 123 controls the operation of an expansion valve selected from the plurality of expansion valves 122. Each selected thermostat measures the temperature within a chamber selected from the plurality of chambers 112.

When the measured temperature in the selected chamber rises above a first previously determined temperature, the selected thermostat opens the expansion valve associated with the selected chamber such that the refrigerant 126 flows through the heat exchange coil selected from the plurality of heat exchange coils 124 that is associated with the selected chamber. When the measured temperature in the selected chamber falls below a second previously determined temperature, the selected thermostat closes the associated expansion valve to stop the flow of the refrigerant 126.

The first previously determined temperature of each selected thermostat is adjustable. The first previously determined temperature of any initially selected thermostat from the plurality of thermostats 123 is independent of the first previously determined temperature of any subsequent thermostat selected from the plurality of thermostats 123. The second previously determined temperature of each selected thermostat is adjustable. The second previously determined temperature of any initially selected thermostat from the plurality of thermostats 123 is independent of the second previously determined temperature of any subsequent thermostat selected from the plurality of thermostats 123.

Each of the plurality of check valves 127 is a check valve that limits the flow of refrigerant 126 through the check valve to a single direction. The thermostat, the expansion valve and the plurality of check valves 127 control the direction of the flow of the refrigerant 126 through the refrigeration system 102. The thermostat, the expansion valve, and the refrigerant 126 are defined elsewhere in this disclosure.

The following ten paragraphs describe the implementation of the first potential embodiment of the disclosure.

The plurality of expansion valves 122 further comprises a first expansion valve 141, a second expansion valve 142, and a third expansion valve 143. The first expansion valve 141 is the expansion valve selected from the plurality of expansion valves 122 that controls the flow of the refrigerant 126 used to cool the first chamber 131. The second expansion valve 142 is the expansion valve selected from the plurality of expansion valves 122 that controls the flow of the refrigerant 126 used to cool the second chamber 132. The third expansion valve 143 is the expansion valve selected from the plurality of expansion valves 122 that controls the flow of the refrigerant 126 used to cool the third chamber 133.

The plurality of thermostats 123 further comprises a first thermostat 151, a second thermostat 152, and a third thermostat 153. The first thermostat 151 is the thermostat selected from the plurality of expansion valves 122 that: a) measures the temperature in the first chamber 131; and, b) controls the opening and the closing of the first expansion valve 141. The second thermostat 152 is the thermostat selected from the plurality of expansion valves 122 that: c) measures the temperature in the second chamber 132; and, d) controls the opening and the closing of the second expansion valve 142. The third thermostat 153 is the thermostat selected from the plurality of expansion valves 122 that: e) measures the temperature in the third chamber 133; and, f) controls the opening and the closing of the third expansion valve 143.

The plurality of heat exchange coils 124 further comprises a first heat exchange coil 161, a second heat exchange coil 162, and a third heat exchange coil 163.

The first heat exchange coil 161 is the heat exchange coil selected from the plurality of expansion valves 122 that cools the interior space of the first chamber 131. The first heat exchange coil 161 receives the refrigerant 126 from the first expansion valve 141 such that the pressure of the refrigerant 126 drops as it passes through the first heat exchange coil 161.

The second heat exchange coil 162 is the heat exchange coil selected from the plurality of expansion valves 122 that cools the interior space of the second chamber 132. The second heat exchange coil 162 receives the refrigerant 126 from the second expansion valve 142 such that the pressure of the refrigerant 126 drops as it passes through the second heat exchange coil 162.

The third heat exchange coil 163 is the heat exchange coil selected from the plurality of expansion valves 122 that cools the interior space of the third chamber 133. The third heat exchange coil 163 receives the refrigerant 126 from the third expansion valve 143 such that the pressure of the refrigerant 126 drops as it passes through the third heat exchange coil 163.

The plurality of check valves 127 further comprises a first check valve 171, a second check valve 172, a third check valve 173, a fourth check valve 174, and a fifth check valve 175.

The first check valve 171 is the check valve selected from the plurality of check valves 127 that prevents the backflow of refrigerant 126 from the condenser 125 into the first heat exchange coil 161. The second check valve 172 is the check valve selected from the plurality of check valves 127 that prevents the backflow of refrigerant 126 from the condenser 125 into the second heat exchange coil 162. The third check valve 173 is the check valve selected from the plurality of check valves 127 that prevents the backflow of refrigerant 126 from the condenser 125 into the third heat exchange coil 163.

The fourth check valve 174 is the check valve selected from the plurality of check valves 127 that prevents the backflow of refrigerant 126 from the compressor 121 into the condenser 125. The fifth check valve 175 is the check valve selected from the plurality of check valves 127 that prevents the backflow of refrigerant 126 from the first expansion valve 141 into the compressor 121. The fifth check valve 175 further prevents the backflow of refrigerant 126 from the second expansion valve 142 into the compressor 121. The fifth check valve 175 further prevents the backflow of refrigerant 126 from the third expansion valve 143 into the compressor 121.

The following definitions were used in this disclosure:

Ball Valve: As used in this disclosure, a ball valve is a type of commercially available check valve.

Barrier: As used in this disclosure, a barrier is a physical obstacle that forms a boundary between a first space and a second space. The barrier prevents the passage of an object between the first space and the second space.

Chamber: As used in this disclosure, a chamber is an enclosed or enclosable negative space that is dedicated to a purpose.

Check Valve: As used in this disclosure, a check valve is a valve that permits the flow of fluid in a single direction. Within selected potential embodiments of this disclosure, the check valve is a commercially available product that is selected from the group consisting of a ball valve and a Tesla valve.

Closed Position: As used in this disclosure, a closed position refers to a movable barrier structure that is in an orientation that prevents passage through a port or an aperture. The closed position is often referred to as an object being "closed." Always use orientation.

Container: As used in this disclosure, a container is a structure that forms a protected space used to store and transport an object. Use protected space.

Enclose: As used in this disclosure, to enclose means to segregate or surround a space or an object from all sides. The noun form of enclose is enclosure.

Enclosable: As used in this disclosure, enclosable refers to an enclosed space that is formed with a port that changes between a closed position and an open position such that access into the enclosed space is both available and controllable.

Expansion Valve: As used in this disclosure, an expansion valve is a device that controls the release of a pressurized refrigerant into a heat exchange cycle. In most cases, the expansion valve will reduce that pressure of the refrigerant as the refrigerant is released into the heat exchange cycle.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Fluidic Circuit: As used in this disclosure, a fluidic circuit is a closed loop path through which a fluid flows. The closed loop will generally initiate and terminate at reservoir.

Fluid Network: As used in this disclosure, a fluid network refers to a transport structure that: a) receives a fluid into the fluid network; b) transports the fluid through a series of pipes, valves, and manifolds; and, c) discharges the fluid from the fluid network.

Foodstuff: As used in this disclosure, a foodstuff refers to an edible material that is used as food or a beverage.

Gas: As used in this disclosure, a gas refers to a state (phase) of matter that is fluid and that fills the volume of the structure that contains it. Stated differently, the volume of a gas always equals the volume of its container.

Hairpin Exchanger: As used in this disclosure, a hairpin exchanger is a heat exchange structure formed a plurality of straight tubes connected using a hairpin tube.

Hairpin Tube: As used in this disclosure, a hairpin tube is a tube or pipe with a non-Euclidean prism structure. The tube or pipe is bent in a "U" shape reminiscent of a hairpin turn. This "U" reverses the actual physical direction of fluid flow while maintaining the direction of the fluid flow through the tube. Hairpin tube structures are often used in heat exchangers.

Heat Transfer: As used in this disclosure, heat transfer refers an exchange of thermal energy between a first object and a second object. In thermodynamics the first and second objects are often referred to as systems. This disclosure assumes that heat transfer occurs through three mechanisms: conduction, convection, and radiation. By conduction is meant that the heat is exchanged through the contact between the first object and the second object which facilitates the direct transfer of the energy of the vibration of the molecules of the first object to the molecules of the second object. By convection is meant that the heat is transferred through the exchange or movement of mass within and between the first object and the second object. By radiation is meant the transfer of heat energy in the form of (typically electromagnetic) waves between the first object and the second object.

Independent: As used in this disclosure, the term independent refers to the relationship between the operation and control of a first device and a second device. The first device and the second device are independent from each other if: a) the operation of the first device is neither impacted nor influenced by the operation of the second device; and, b) the operation of the second device is neither impacted nor influenced by the operation of the first device.

Insulating Material: As used in this disclosure, an insulating material is a material that inhibits, and ideally prevents, the transfer of heat through the insulating material. Insulating materials may also be used to inhibit or prevent the transfer of sound or the conduction of electricity through the insulating material. Methods to form insulating materials include, but are not limited to: 1) the use of materials with low thermal conductivity; and, 2) the use of a structural design that places a vacuum within the insulating material within the anticipated transfer path of the heat, sound, or electric current flow.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Liquid: As used in this disclosure, a liquid refers to a state (phase) of matter that is fluid and that maintains, for a given pressure, a fixed volume that is independent of the volume of the container.

Negative Space: As used in this disclosure, negative space is a method of defining an object through the use of open or empty space as the definition of the object itself, or, through the use of open or empty space to describe the boundaries of an object.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Permanent: As used in this disclosure, the term permanent refers to a fundamental state, condition or location of an object, process, or arrangement that is not subject to, or expected to be, changed. A perpetual object refers to a permanent object that is expected to last over an unlimited period of time. A building such as a house or a skyscraper would be considered permanent. An ocean would be considered perpetual.

Polymer: As used in this disclosure, a polymer refers to a molecular chain that comprises multiple repeating units known as monomers. The repeating unit may be an atom or a molecular structure.

Protected Space: As used in this disclosure, a protected space is a negative space within which an object is stored. The protected space is enclosed by a barrier structure that: a) prevents damage to the object contained within the protected space; or, b) maintains an environment suitable within the protected space that is appropriate for the object.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Refrigerant: As used in this disclosure, a refrigerant is a fluid used as the heat exchange medium in a heat exchange system.

Temporary: As used in this disclosure, the term temporary refers to a state, condition or location of an object, process, or arrangement that is intended to last for a limited period of time. The term temporary is the opposite of permanent. The term transient refers to a temporary state or condition of an object that degrades over time. In physical processes, the term transient tends to imply a short period of time.

Tesla Valve: As used in this disclosure, a Tesla valve is a type of check valve that requires the use of no moving parts.

Thermostat: As used in this disclosure, a thermostat is a device that monitors the temperature of a space such that the thermostat 1) operates a switch when the measured temperature exceeds or falls below a first preset temperature; and, 2) performs the opposite operation on the switch when the measured temperature falls below or exceeds a second preset temperature. The thermostat is well-known and documented in the electrical arts.

Valve: As used in this disclosure, a valve is a device that is used to control the flow of a fluid (gas or liquid) through a pipe, tube, or hose.

Vinyl: As used in this disclosure, a vinyl refers to a chemical structure with a form RHC═CH2. In this structure, the R refers to a chemical substance including, but not limited to, a functional group, a halide, and a hydrogen atom. A polymer is often formed from vinyl monomers by breaking the double bond between the carbon atoms in a manner that forms a chain of vinyl monomers linked by single bonded carbon atoms.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A refrigerator and freezer conversion system comprising an insulating cabinet and a refrigeration system;

wherein the refrigeration system maintains the temperature within the insulating cabinet;

wherein the refrigerator and freezer conversion system is configured for use with a refrigerator;

wherein the refrigerator and freezer conversion system is configured for use with foodstuff;

wherein the insulating cabinet is organized into a plurality of chambers;

wherein the refrigeration system independently maintains the temperature within each of the plurality of chambers;

wherein by independently maintained is meant that the temperature maintained in any initial chamber selected from the plurality of chambers is not affected by the temperature of any subsequent chamber selected from the plurality of chambers;

wherein the refrigeration system comprises a compressor, a plurality of expansion valves, a plurality of thermostats, a plurality of heat exchange coils, a condenser, a refrigerant, and a plurality of check valves;

wherein the compressor is a mechanical device;

wherein the compressor forms a fluidic series connection from the condenser to the plurality of expansion valves;

wherein the compressor draws the refrigerant from the condenser;

wherein the compressor places the refrigerant under pressure such that the refrigerant is transported under pressure to the plurality of expansion valves.

2. The refrigerator and freezer conversion system according to claim 1 wherein the insulating cabinet is an enclosable container;

wherein the insulating cabinet forms the exterior surfaces of the refrigerator and freezer conversion system;

wherein the insulating cabinet is an insulating structure.

3. The refrigerator and freezer conversion system according to claim 2 wherein the refrigeration system is a mechanical implementation of a fluidic circuit called the Carnot cycle, and the refrigeration system is used to cool the plurality of chambers within the insulating cabinet;

wherein the refrigeration system pressurizes the refrigerant that is used by the refrigeration system to implement the Carnot cycle;

wherein the refrigerant is a compressible fluid that is pumped through the fluidic circuit used by the refrigeration system to create the Carnot cycle;

wherein the refrigeration system places the refrigerant under pressure such that the refrigerant generates a cooling effect when the pressure that the refrigerant is under is subsequently released by the refrigeration system.

4. The refrigerator and freezer conversion system according to claim 3 wherein the insulating cabinet comprises an outer insulating shell and the plurality of chambers;

wherein the outer insulating shell contains the plurality of chambers;

wherein the outer insulating shell contains the refrigeration system.

5. The refrigerator and freezer conversion system according to claim 4 wherein the compressor, the plurality of expansion valves, the plurality of thermostats, the plurality of heat exchange coils, the condenser, and the plurality of check valves transport the refrigerant through the fluidic circuit.

6. The refrigerator and freezer conversion system according to claim 5 wherein the outer insulating shell forms the exterior structure of the refrigerator and freezer conversion system;

wherein the outer insulating shell is an insulating structure;

wherein the outer insulating shell is a hollow structure;

wherein the outer insulating shell forms an enclosable space that provides access to each of the plurality of chambers;

wherein the outer insulating shell is subdivided into the plurality of chambers.

7. The refrigerator and freezer conversion system according to claim 6 wherein each of the plurality of chambers forms a temperature controlled space;

wherein each of the plurality of chambers is an independent structure;

wherein by independent structure is meant that the temperature maintained in any chamber initially selected from the plurality of chambers is not affected by the temperature of any subsequent chamber selected from the plurality of chambers.

8. The refrigerator and freezer conversion system according to claim 7 wherein the plurality of chambers further comprises a first chamber, a second chamber, a third chamber, and a chamber divider;

wherein the first chamber is a permanent chamber that is formed in the hollow interior of the outer insulating shell;

wherein the second chamber is a permanent chamber that is formed in the hollow interior of the outer insulating shell;

wherein the third chamber is a temporary structure formed within the second chamber.

9. The refrigerator and freezer conversion system according to claim 8 wherein the temperature within the first chamber is adjustable;

wherein the first chamber is intended to store foodstuff in a frozen condition;

wherein the temperature within the second chamber is adjustable;

wherein the second chamber is intended to store foodstuff in a thawed condition;

wherein the third chamber removably installs in the second chamber;

wherein the temperature within the third chamber is adjustable;

wherein the third chamber is intended to store foodstuff in condition selected from the group consisting of a thawed condition and a frozen condition.

10. The refrigerator and freezer conversion system according to claim 9 wherein the chamber divider is an insulating structure;

wherein the chamber divider removably installs in the second chamber to form the third chamber;

wherein the chamber divider forms a gas impermeable structure that prevents the exchange of gas between the second chamber and the third chamber such that the refrigeration system controls the temperature within the third chamber independently from the temperature in the second chamber;

wherein the chamber divider forms an enclosable space such that any foodstuff contained in the third chamber is accessible through the second chamber.

11. The refrigerator and freezer conversion system according to claim 10 wherein each of the plurality of expansion valves is a mechanical device;

wherein the plurality of expansion valves forms a fluidic series connection from the compressor to a heat exchange coil selected from the plurality of heat exchange coils;

wherein each selected heat exchange coil forms a volume expansion structure that controls the pressure of the refrigerant as the refrigerant decreases the temperature of the heat exchange coil within a chamber selected from the plurality of chambers.

12. The refrigerator and freezer conversion system according to claim 11 wherein the condenser is a mechanical device;

wherein the condenser is a containment structure;

wherein the condenser forms a fluidic series connection from the condenser to the compressor;

wherein the condenser forms a reservoir that contains the refrigerant when the compressor is not in operation.

13. The refrigerator and freezer conversion system according to claim 12 wherein each expansion valve selected from the plurality of expansion valves a installs between the compressor and the heat exchange coil selected from the plurality of heat exchange coils;

wherein each of the plurality of expansion valves directly controls the pressure of the refrigerant as the refrigerant enters the heat exchange coil associated with the selected expansion valve.

14. The refrigerator and freezer conversion system according to claim 13 wherein each of the plurality of thermostats are control structures;

wherein each thermostat selected from the plurality of thermostats controls the operation of an expansion valve selected from the plurality of expansion valves;

wherein each selected thermostat measures the temperature within the chamber selected from the plurality of chambers;

wherein when the measured temperature in the selected chamber rises above a first previously determined temperature, the selected thermostat opens the expansion valve associated with the selected chamber such that the refrigerant flows through the heat exchange coil selected from the plurality of heat exchange coils that is associated with the selected chamber;

wherein when the measured temperature in the selected chamber falls below a second previously determined temperature, the selected thermostat closes the associated expansion valve to stop the flow of the refrigerant;

wherein the first previously determined temperature of each selected thermostat is adjustable;

wherein the first previously determined temperature of any initially selected thermostat from the plurality of thermostats is independent of the first previously determined temperature of any subsequent thermostat selected from the plurality of thermostats;

wherein the second previously determined temperature of each selected thermostat is adjustable;

wherein the second previously determined temperature of any initially selected thermostat from the plurality of thermostats is independent of the second previously determined temperature of any subsequent thermostat selected from the plurality of thermostats.

15. The refrigerator and freezer conversion system according to claim 14 wherein each of the plurality of check valves is a check valve that limits the flow of refrigerant through the check valve to a single direction;

wherein the thermostat, the plurality of expansion valves and the plurality of check valves control the direction of the flow of the refrigerant through the refrigeration system.

16. The refrigerator and freezer conversion system according to claim 15 wherein the plurality of expansion valves further comprises a first expansion valve, a second expansion valve, and a third expansion valve;

wherein the first expansion valve is the expansion valve selected from the plurality of expansion valves that controls the flow of the refrigerant used to cool the first chamber;

wherein the second expansion valve is the expansion valve selected from the plurality of expansion valves that controls the flow of the refrigerant used to cool the second chamber;

wherein the third expansion valve is the expansion valve selected from the plurality of expansion valves that controls the flow of the refrigerant used to cool the third chamber.

17. The refrigerator and freezer conversion system according to claim 16 wherein the plurality of thermostats further comprises a first thermostat, a second thermostat, and a third thermostat;

wherein the first thermostat is the thermostat selected from the plurality of thermostats that: a) measures the temperature in the first chamber; and, b) controls the opening and the closing of the first expansion valve;

wherein the second thermostat is the thermostat selected from the plurality of thermostats that: c) measures the temperature in the second chamber; and, d) controls the opening and the closing of the second expansion valve;

wherein the third thermostat is the thermostat selected from the plurality of thermostats that: e) measures the temperature in the third chamber; and, f) controls the opening and the closing of the third expansion valve.

18. The refrigerator and freezer conversion system according to claim 17 wherein the plurality of heat exchange coils further comprises a first heat exchange coil, a second heat exchange coil, and a third heat exchange coil;

wherein the first heat exchange coil is the heat exchange coil selected from the plurality of heat exchange coils that cools the interior space of the first chamber;

wherein the first heat exchange coil receives the refrigerant from the first expansion valve such that the pressure of the refrigerant drops as it passes through the first heat exchange coil;

wherein the second heat exchange coil is the heat exchange coil selected from the plurality of heat exchange coils that cools the interior space of the second chamber;

wherein the second heat exchange coil receives the refrigerant from the second expansion valve such that the pressure of the refrigerant drops as it passes through the second heat exchange coil;

wherein the third heat exchange coil is the heat exchange coil selected from the plurality of heat exchange coils that cools the interior space of the third chamber;

wherein the third heat exchange coil receives the refrigerant from the third expansion valve such that the pressure of the refrigerant drops as it passes through the third heat exchange coil.

19. The refrigerator and freezer conversion system according to claim 18 wherein the plurality of check valves further comprises a first check valve, a second check valve, a third check valve, a fourth check valve, and a fifth check valve;

wherein the first check valve is the check valve selected from the plurality of check valves that prevents the backflow of refrigerant from the condenser into the first heat exchange coil;

wherein the second check valve is the check valve selected from the plurality of check valves that prevents the backflow of refrigerant from the condenser into the second heat exchange coil;

wherein the third check valve is the check valve selected from the plurality of check valves that prevents the backflow of refrigerant from the condenser into the third heat exchange coil;

wherein the fourth check valve is the check valve selected from the plurality of check valves that prevents the backflow of refrigerant from the compressor into the condenser;

wherein the fifth check valve is the check valve selected from the plurality of check valves that prevents the backflow of refrigerant from the first expansion valve into the compressor;

wherein the fifth check valve further prevents the backflow of refrigerant from the second expansion valve into the compressor;

wherein the fifth check valve further prevents the backflow of refrigerant from the third expansion valve into the compressor.

* * * * *